United States Patent [19]

Fugett

[11] Patent Number: 4,631,762

[45] Date of Patent: Dec. 30, 1986

[54] HOSPITAL BED WITH TOILET FACILITY

[76] Inventor: Mary B. Fugett, 617½ Anniston, Dr., Lexington, Ky. 40505

[21] Appl. No.: 732,616

[22] Filed: May 10, 1985

[51] Int. Cl.[4] ..... A61G 7/02

[52] U.S. Cl. ..... 5/90; 5/413

[58] Field of Search ..... 5/65, 90, 463

[56] References Cited

U.S. PATENT DOCUMENTS

| | | | |
|---|---|---|---|
| 307,717 | 11/1884 | Gunold | 5/90 |
| 787,162 | 4/1905 | Feely | 5/90 |
| 1,046,830 | 12/1912 | McDonald et al. | 5/90 |
| 1,224,478 | 5/1917 | McNeil | 5/90 |
| 1,257,072 | 2/1918 | Fazukerley | 5/90 |
| 1,291,822 | 1/1919 | Foust | 5/90 |
| 2,105,040 | 1/1938 | Hurst | 5/90 |
| 2,285,474 | 6/1942 | Urie | 5/90 |
| 2,598,859 | 6/1952 | Thompson | 5/90 |
| 3,922,735 | 12/1975 | Kato | 5/90 |
| 3,943,583 | 3/1976 | Ichikawa | 5/90 |

*Primary Examiner*—Gary L. Smith
*Assistant Examiner*—Michael F. Trettel
*Attorney, Agent, or Firm*—Harvey B. Jacobson

[57] ABSTRACT

A basically conventional hospital bed is provided with one side portion of the intermediate length area of the mattress of the bed mounted from the bed frame for horizontal shifting toward a laterally outwardly projecting position in a manner such that an opening in the mattress is provided between the outwardly shifted side portion of the mattress and the opposite side portion of the mattress. The opening is generally centered relative to the opposite sides of the bed frame and a waste receiver is mounted beneath the mattress in registry with the opening. The receiver is mounted for vertical shifting between a lowered position beneath the mattress and a raised position projecting upwardly into the opening. The receiver includes a lower outlet for draining into a domestic sewer system or a holding tank and the inner periphery of the upper portion of the receiver is provided with a circumferentially extending manifold including outlets for discharging fluids downwardly along the walls of the receiver. Water supply means either in the form of a supply tank mounted from the bed at an elevation above the receiver or a domestic pressurized water supply is used to supply water to the manifold when desired.

9 Claims, 10 Drawing Figures

HOSPITAL BED WITH TOILET FACILITY

BACKGROUND OF THE INVENTION

1. Field of the Invention

This invention relates to a hospital or convalescent bed including a frame and incorporating head and foot mattress portions as well as an intermediate mattress portion supported from the frame and disposed between the head and foot mattress portions. One side of the intermediate mattress portion is mounted from the frame for lateral outward shifting from the corresponding side of the frame to define a void or opening through the mattress inwardly of the laterally outwardly displaced intermediate mattress portion. An upwardly opening waste receptacle is supported from the frame beneath the mattress and in registry with the opening or void for receiving waste thereinto. Further, the receptacle is mounted from the frame for vertical shifting relative thereto between a lowered position below the mattress and an upper position projecting upwardly into the void or opening defined when the one side mattress intermediate portion is shifted laterally outwardly of the corresponding frame side.

2. Description of Related Art

Various different forms of bed constructions heretofore have been provided including toilet facilities. Examples of these different forms of bed constructions as well as other toilet facility structures including some of the general structural and operational features of the instant invention are disclosed in U.S. Pat. Nos. 1,224,478, 1,227,399, 2,443,905, 2,506,183 and 2,689,354.

However, these previously known structures do not include those structural features of the instant invention which particularly well coact with each other to provide a hospital bed including a toilet facility which can be readily used by many hospital and convalescent bed patients.

SUMMARY OF THE INVENTION

The problem of providing sanitary toilet facilities for patients confined to beds is considerable and involves, in many cases, unnecessary discomfort to the patients as well as considerable time on the part of one or more caretakers or nurses, not to mention the embarrassment to some patients and the cost to consumers of invalid care.

At present, in the apparent absence from a hospital or invalid room of a simple, reliable and cost-effective bed toilet, the conventional, but difficult and time consuming, hospital bedpan is the only widely used means of providing toilet facilities to the bed-restricted patient.

The main object of this invention is to provide a hospital bed including a toilet facility which can be used by many persons confined to a bed without requiring the help of one or more attendants.

Another object of this invention is to provide a bed including toilet facilities and a shiftable mattress component movable between a normal hospital bed defining position and a toilet facility providing position as well as electrically operated power means for converting between a conventional hospital bed mode and a toilet facility providing mode with power means being readily controllable by many persons confined to a bed.

Yet another object of this invention is to provide a hospital bed including a toilet facility and wherein the waste received by the toilet facility is retained in a holding tank supported from the bed or ducted directly to an adjacent sewer facility provided for that purpose.

A final object of this invention to be specifically enumerated herein is to provide a hospital bed including a toilet facility and which will conform to conventional forms of manufacturing, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
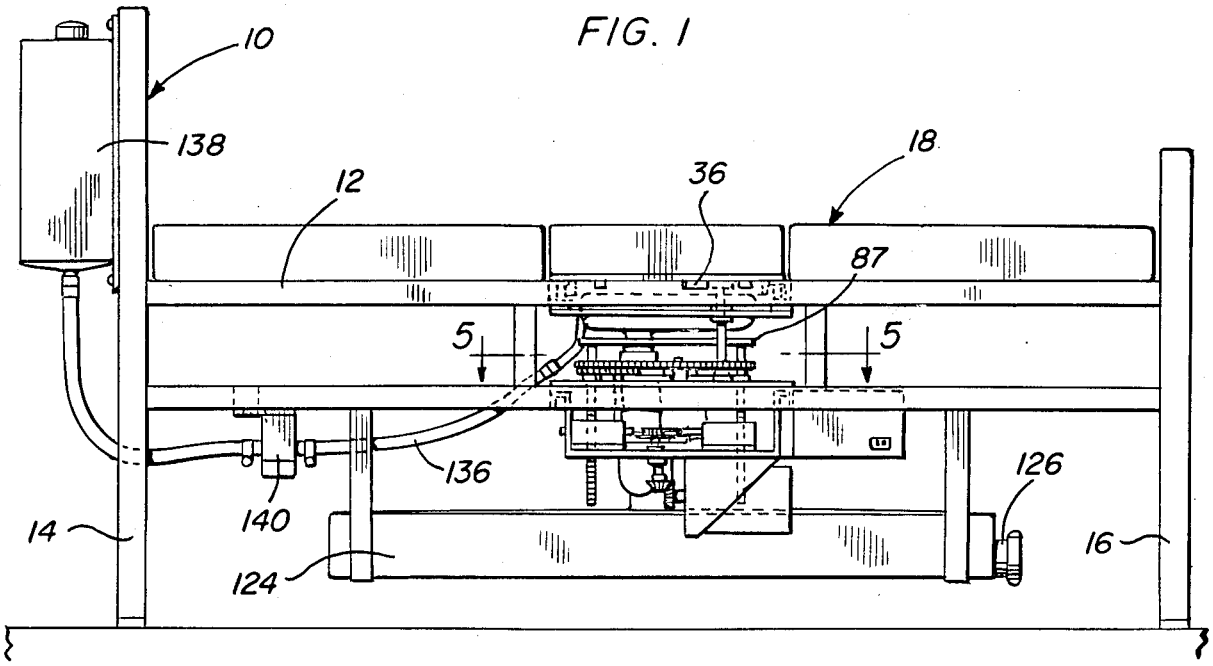
FIG. 1 is a side elevational view of a hospital bed constructed in accordance with the present invention and including a holding tank for toilet waste and its own supply of water for flushing the toilet facility.

Referring now more specifically to the drawings, the numeral 10 generally designates a first form of a hospital bed constructed in accordance with the present invention. The bed 10 includes a somewhat conventional frame 12 including head and foot boards 14 and 16. A mattress assembly referred to in general by the reference numeral 18 is supported from the frame 12 and includes stationary head and foot portions 20 and 22, a stationary left mid-portion 24 and a laterally shiftable right mid-portion 26. The portions 22, 24 and 26 are illustrated as separate portions, but they may be integrally formed with only the portion 26 being separately formed.

The frame 12 includes longitudinally spaced transverse tracks 28 and 30 from which the portion 26 is movably supported through the utilization of support wheels 32 rollingly engaged with the tracks 28 and 30. In addition, the portion 26 includes a rack gear 36 supported therefrom with which a pinion gear 38 is meshed and the pinion gear 38 is mounted on the upper end of a shaft 40 journalled from a plate 41 supported from the frame 12. The lower end of shaft 40 has a gear wheel 42 mounted thereon with which a gear 44 is meshed, the gear 44 being mounted on the upper end of a shaft 45 journalled from a plate 43 supported from the frame 12 and the lower end of shaft 45 having a gear 46 thereon, see FIG. 5.

An electric and reversible gear reduction motor 48 is supported from the frame 12 and includes an output shaft 50 upon which a bevel gear 52 is mounted.

An intermediate shaft 54 is journalled from the plate 43 and a lower plate 55 supported from the frame 12 and includes a bevel gear 56 on its lower end meshed with the bevel gear 52 and a gear 58 mounted on its upper end. A control arm 60 is oscillatably mounted on the shaft 54 below the gear 58 and rotatably journals a transfer gear 62 from one end swingable into and out of meshed engagement with the gear 46. The other end of the control arm 60 includes a pair of opposite side longitudinal slots 64 and 66 with which the outer free ends of the armatures 68 and 70 of first and second solenoids 72 and 74 enjoy pin and slot connections. The gear 62 is in constant mesh with the gear 58.

Figure 5:
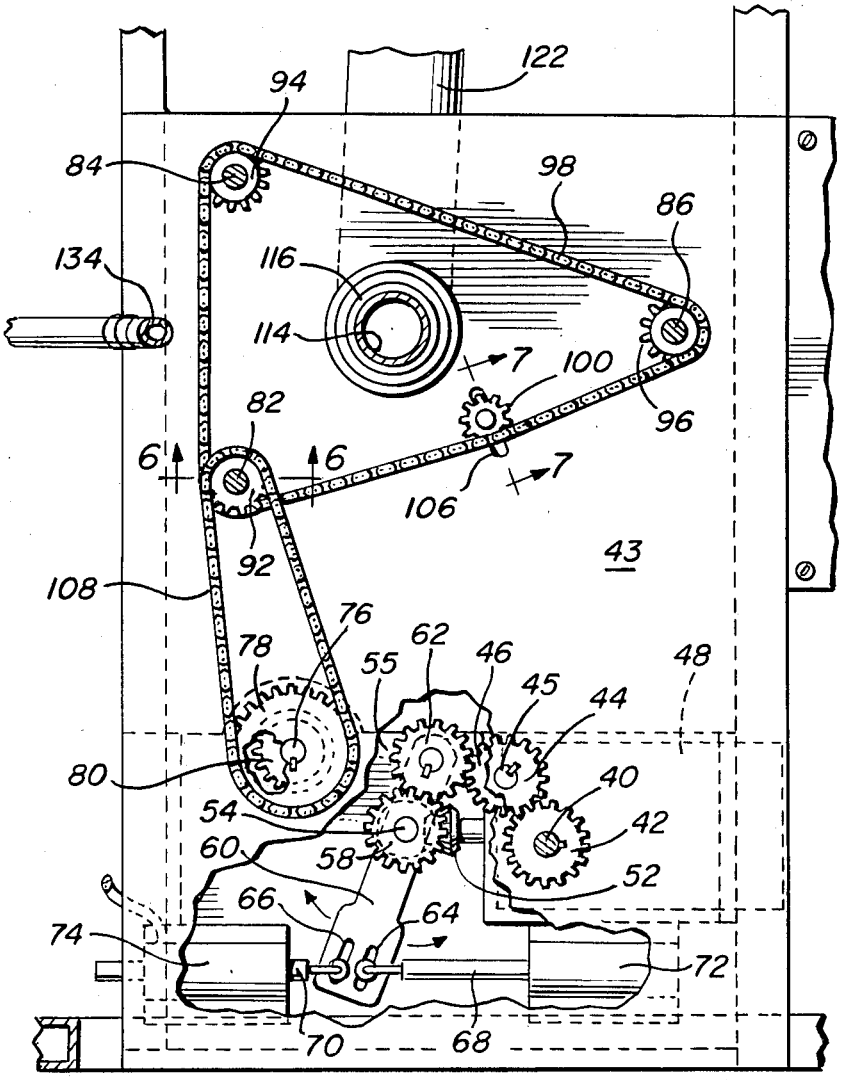
FIG. 5 is a fragmentary enlarged horizontal sectional view taken substantially upon the plane indicated by the section line 5—5 of FIG. 1 and illustrating the drive mechanism for raising and lowering the waste receiver portion of the bed.
Figure 6:
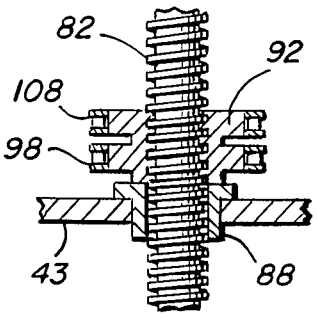
FIG. 6 is an enlarged fragmentary vertical sectional view taken substantially upon the plane indicated by the section line 6—6 of FIG. 5.
Figure 7:
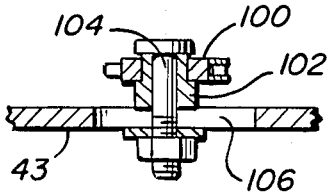
FIG. 7 is an enlarged fragmentary vertical sectional view taken substantially upon the plane indicated by the section line 7—7 of FIG. 5.
Figure 8:
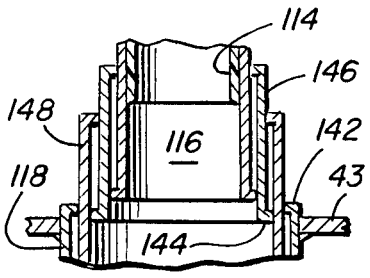
FIG. 8 is an enlarged fragmentary vertical sectional view illustrating the telescopic connection between the relatively shiftable components of the outlet structure for the waste receiver portion of the invention.

Also journalled from the plate 55 is a shaft 76 having a sprocket gear 78 mounted on its upper end and a gear 80 mounted on its lower end, see FIG. 5. Upon actuation of the solenoid 72 in order to angularly displace the control arm 60 in a counterclockwise direction as viewed in FIG. 5, the gear 62 is swung out of meshed engagement with the gear 46 and into meshed engagement with the gear 80.

A set of three screw shafts 82, 84 and 86 depend downwardly from a support plate 87 and are guidingly received through sleeves 88 secured through the plate 43 and three sprocket wheels 92, 94 and 96 are threaded on the shafts 82, 84 and 86 and bear downward upon the sleeves 88. An endless chain 98 is trained about the sprocket wheels 92, 94 and 96 and also about a sprocket wheel 100 journalled from the plate 43. The sprocket wheel 100 is journalled from a sleeve 102 mounted from the plate 43 by a mounting shank 104 shiftable longitudinally of a slot 106 provided in the plate 43. In addition, the sprocket wheel 92 comprises a double sprocket wheel and an endless chain 108 is trained about the sprocket gear 78 and the upper sprocket portion of the sprocket wheel 92, the chain 98 being trained about the lower sprocket portion of the sprocket wheel 92.

Figure 2:
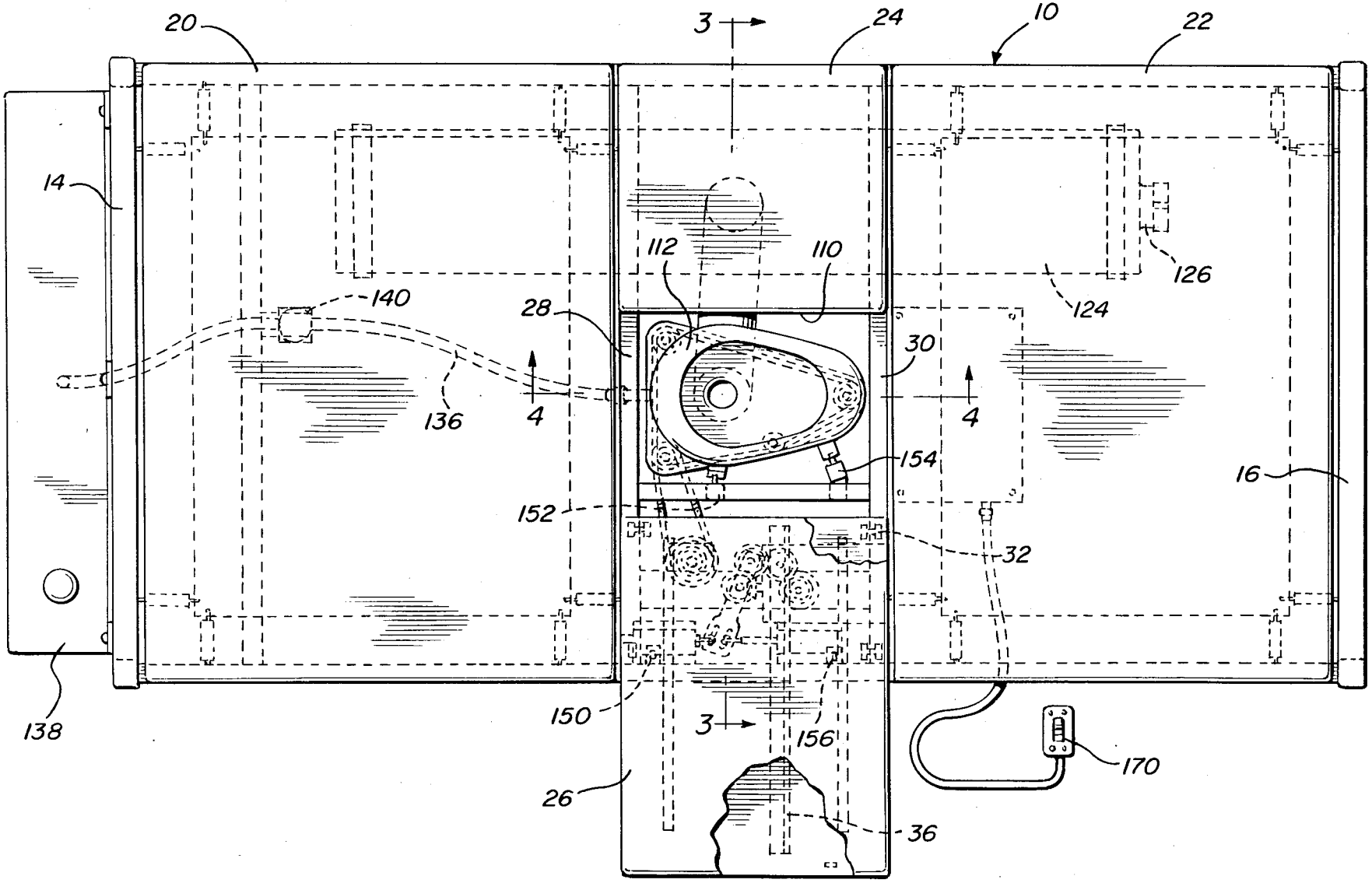
FIG. 2 is an enlarged top plan view of the bed with the shiftable intermediate length side portion of the bed mattress in a laterally outwardly displaced position to expose the center toilet facility of the bed.

When the portion 26 is laterally displaced outward of the righthand side of the bed in the manner illustrated in FIG. 2 of the drawings, a central opening or void 110 is defined vertically through the mattress assembly 18 in a generally centered position with respect thereto and the plate 87 is substantially centered relative to the opening 110.

An upwardly opening waste receiver 112 is provided and includes a central depending outlet neck 114 removably secured in the upper end of a depending sleeve 16 secured through the plate 87. A connecting sleeve 118 is secured through the plate 43 and has the inlet end 120 of a P-trap connected thereto, the P-trap 122 discharging into a holding tank 124 suspended beneath the frame 12 and including a removably capped outlet 126 whereby the holding tank 124 occasionally may be drained. The receiver 112 includes a peripherally extending inwardly and downwardly curved lip 128 extending about its upper open end beneath which an annular manifold pipe 130 is mounted. The manifold pipe 130 includes a plurality of longitudinally spaced outlets 132 for discharging water into the receiver 112 and the manifold pipe 130 includes an inlet neck 134 to which the discharge end of a supply hose 136 is connected. The inlet end of the supply hose 136 opens into the bottom of an elevated water supply tank 138 carried by the head board 14 and the supply hose 136 includes an electrically actuatable pump 140 serially connected therein.

The sleeve 118 includes an inturned lip 142 on its upper end and the sleeve 116 includes an outturned lip 144 on its lower end. A pair of slidably engaged upper and lower inner and outer connecting sleeves 146 and 148 are interposed between the sleeves 116 and 118 and include inturned and outturned lips on their upper and lower ends. The connecting sleeve 146 is slidably engaged with the sleeve 116 and the connecting sleeve 148 is slidably engaged with the sleeve 118. The upper inturned and lower outturned lips of the sleeves 148 and 146 are engageable with each other to limit extension of the sleeves 146 and 148 relative to each other while the inturned lip of the sleeve 146 is enageable with the outturned lip 144 of the sleeve 116 to limit extension of the sleeve 146 relative to the sleeve 116. Further, the outturned lip at the lower end of the sleeve 148 is engageable with inturned lip 142 at the upper end of the sleeve 118 to limit extension of the sleeve 148 relative to the sleeve 118.

Figure 3:
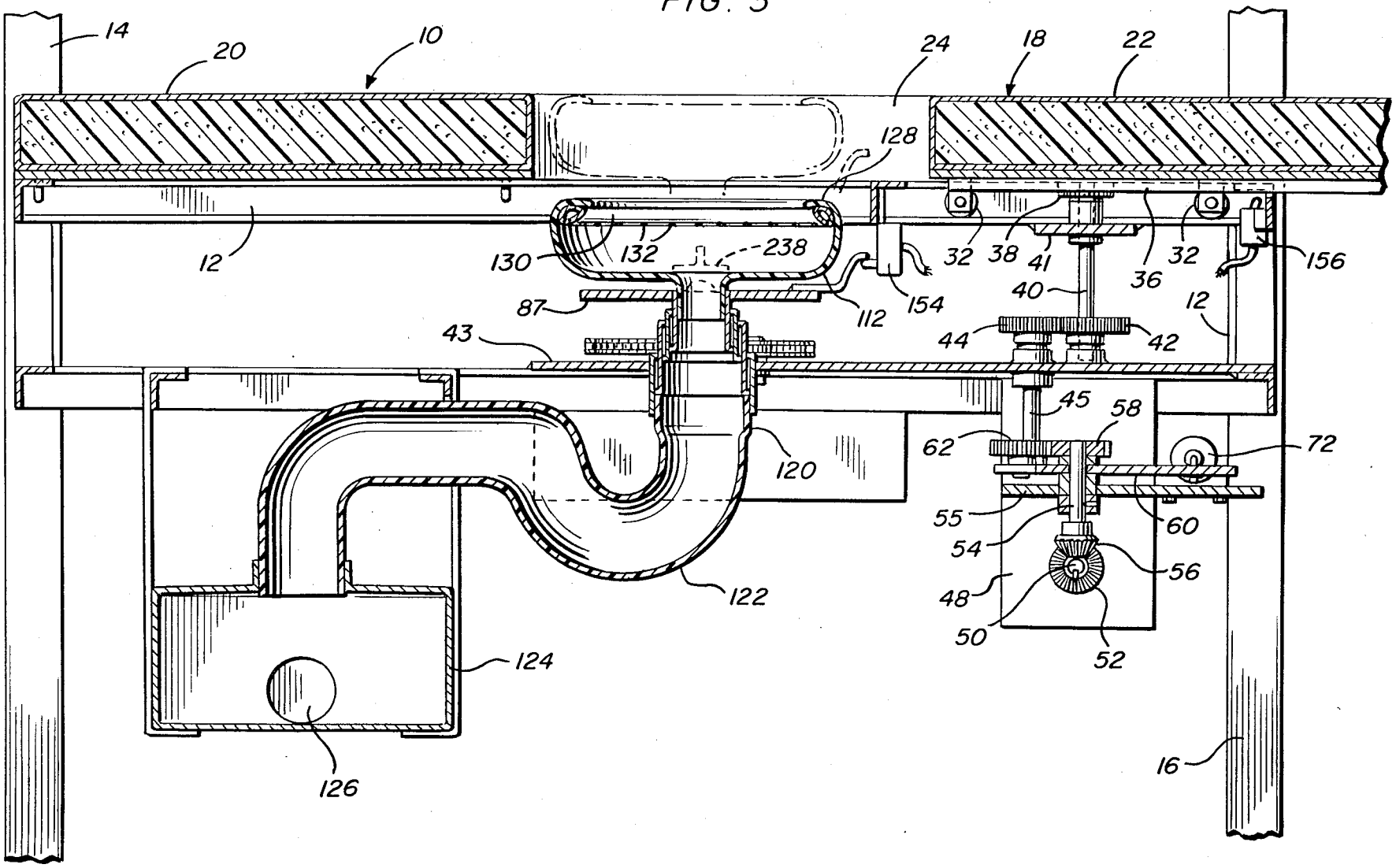
FIG. 3 is an enlarged vertical sectional view taken substantially upon the plane indicated by the section line 3—3 of FIG. 2 and with an alternate elevated position of the receptacle portion of the toilet facility shown in phantom lines.
Figure 4:
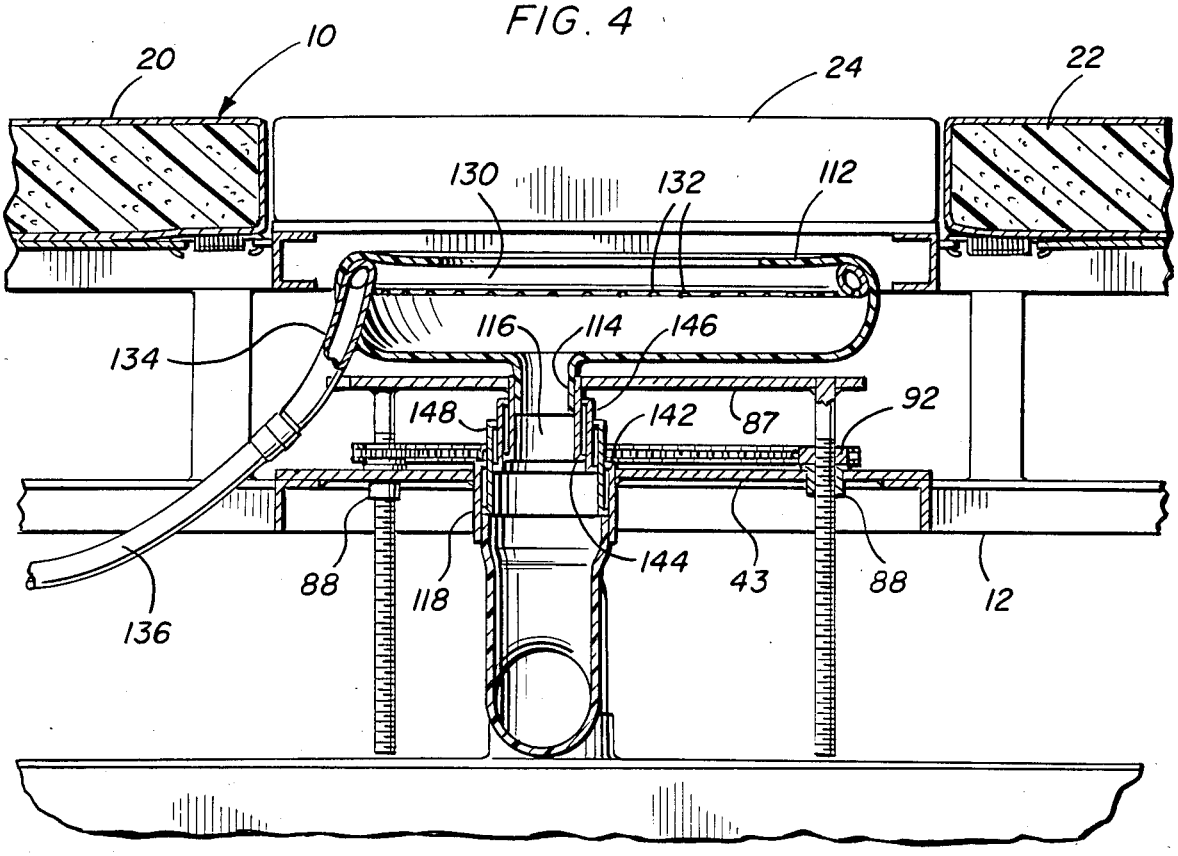
FIG. 4 is a fragmentary enlarged vertical sectional view taken substantially upon the plane indicated by the section line 4—4 of FIG. 2.

From FIG. 3 of the drawings, it may be seen that the receiver 112 may be upwardly extended from a downwardly retracted position below the mattress assembly 18 to an upper operative position substantially flush with the upper surface of the mattress assembly 18. The telescopic engagement of the outlet neck 114 and the sleeves 118, 146 and 148 enables the receiver 112 to maintain a fluid tight connection with the sleeve 118 throughout vertical adjustment of the receiver 112.

Figure 9:
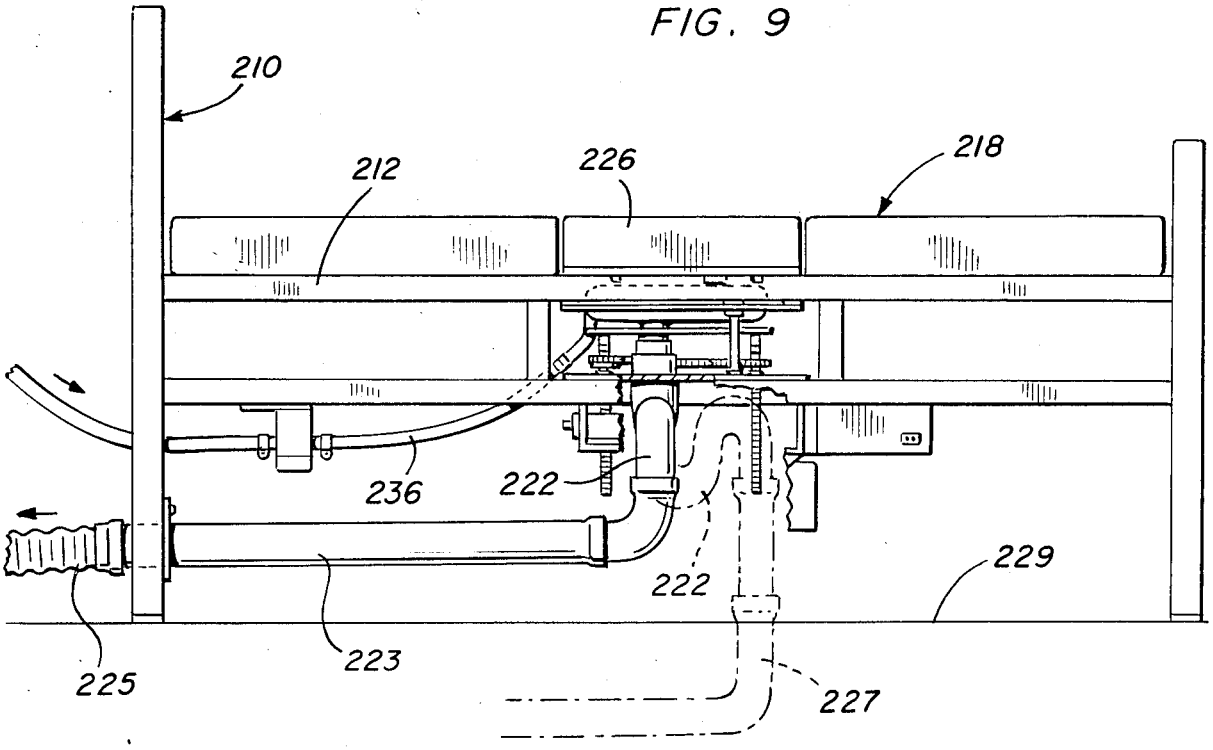
FIG. 9 is a side elevational view of a modified form of bed utilizing drainage structure for draining toilet waste directly into an adjacent sewer facility and wherein water for flushing the receiver portion of the toilet facility may be provided from a conventional domestic water supply.

With attention now invited more specifically to FIG. 9 of the drawings, there may be seen a bed referred to in general by the reference numeral 210 and which is substantially identical to the bed 10 and therefore has the various components thereof corresponding to similar components of the bed 10 designated by reference numerals in the 200 series corresponding to those reference numerals indicating the various components of the bed 10.

The bed 210 differs from the bed 10 in that the supply hose 236 has its inlet end communicated with a source (not shown) of pressurized domestic water as opposed to a tank corresponding to the tank 138. Accordingly, the bed 210 does not have a water supply tank supported therefrom. In addition, the P-trap 222 of the bed 210 opens into an inclined drain pipe 223 which in turn drains into a flexible hose 225 having its outlet end communicated with a domestic sewer input portion. Also, the P-trap 222 may discharge directly into a sewer coupling 227 opening upwardly through the floor 229 immediately beneath the bed 210. Otherwise, the structure and operation of the bed 210 is identical to the structure and operation of the bed 10.

Figure 10:
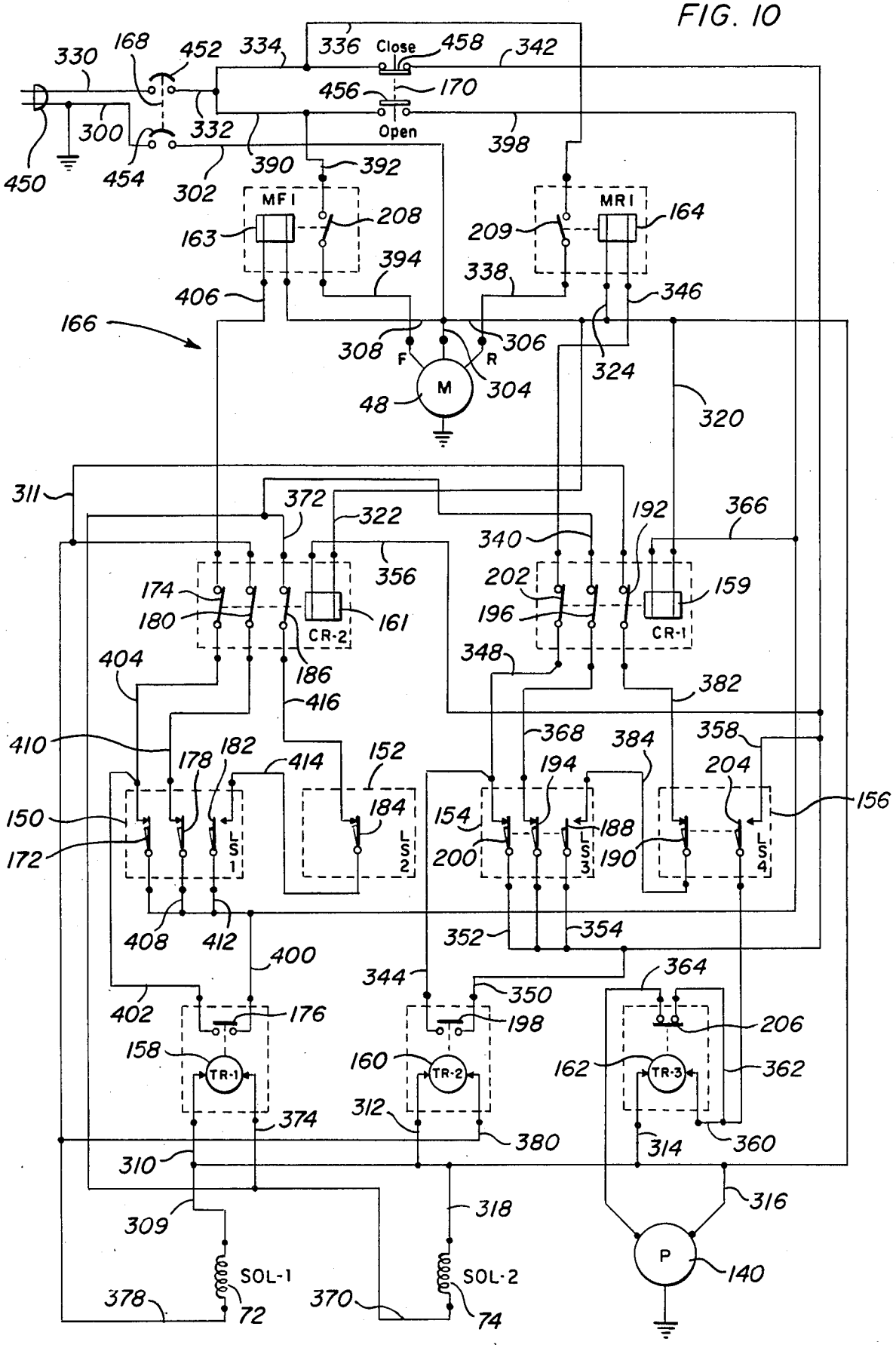
FIG. 10 is a diagrammatic view of the electrical power circuitry of the bed.

The bed 10 includes first, second, third and fourth limit switches 150, 152, 154 and 156; first and second solenoids 72 and 74; first, second and third timer relays 158, 160 and 162; first and second control relays 159 and 161 and forward and reverse starter relays 163 and 164 for motor 48 electrically connected in a control circuit 166, see FIG. 10. The control circuit 166 also includes an on/off switch 168 and a control switch 170 and the motor 48 and pump 140 are also electrically connected in the control circuit 166, see FIG. 10.

With attention now invited more specifically to FIG. 10, it may be seen that the circuit 166 includes a plug 450 adapted to be electrically connected to any suitable 110-volt domestic electrical system. The plug 450 as two wires 300 and 330 electrically connected thereto, wire 300 comprising the ground wire and the wires 300 and 330 being electrically connected to the on/off switch 168 including bridging contacts 452 and 454. In addition, wires 302 and 332 are electrically connected to the switch 168. Wire 302 is connected to wire 306 comprising the main neutral wire extending throughout the entire circuit 166. Wire 332 is connected to wire 334 and wire 390 and wires 334 and 390 are connected to control switch 170 including a pair of bridging contacts 456 and 458.

Wires 342 and 398 are electrically connected to the switch 170 and the wire 342 is connected to the terminal of the bridging contact 200 of the third limit switch designated by the reference numeral 154. In addition, wires 352 and 354 extend from wire 342 and are electrically connected to the terminals of the bridging contacts 194 and 188 of limit switch 154. Wire 398, on the other hand, is electrically connected to the terminal of bridging contact 172 of the first limit switch designated by the reference numeral 150 and wires 408 and 412 are electrically connected to the wire 398 and to the terminals of bridging contacts 178 and 182 of the first limit switch 150.

Wire 336 extends from wire 334 to one contact of the switch 209 in the motor relay 164 and wire 338 electrically connects the other contact of switch 209 to the reverse windings of the motor 48. Wire 392 electrically connects wire 390 to the first contact of switch 208 under the control of the motor starter relay 163 and wire 394 electrically connects the other contact of switch 208 to the forward windings of the motor 48. In addition, wire 304 electrically connects wire 302 to the neutral terminal of the motor 48.

Wire 308 electrically connects wire 302 with one terminal of the relay 163 and the other terminal of the relay 163 is electrically connected to a first terminal of the control relay 161 by wire 406.

Wire 306 electrically connects wire 302 with a first terminal of timer relay 158 by wire 310 and to the first solenoid 72 by wire 309. In addition, wire 306 is electrically connected to the second solenoid 74 by wire 318 and to the pump 140 by wire 316. Wire 378 electrically connects solenoid 72 with the second terminal of control relay 161 and wire 370 electrically connects the second solenoid 74 with the third terminal of control relay 161 by wire 372. In addition, the second contact of the timer relay 158 is electrically connected to wire 370 by wire 374.

Wire 312 electrically connects the first terminal of timer relay 160 with wire 306 and wire 380 electrically connects the second terminal of timer relay 160 to wire 378. The first terminal of timer relay 162 is electrically connected to wire 306 by wire 314 and wire 360 electrically connects the second terminal of timer relay 162 with the first terminal of limit switch 156. The first contact of the timer relay switch 206 is electrically connected to wire 360 by wire 362 and the second terminal of the time relay switch 206 is electrically connected to the pump 140 by wire 364. The first terminal of timer relay switch 198 of timer relay 160 is electrically connected to wire 342 by wire 350 and the second terminal of the switch 198 of timer relay 160 is electrically connected to the first terminal of limit switch 154 by wire 344. The first terminal of the switch 176 of timer relay 158 is electrically connected to wire 398 by wire 400 and the second terminal of the switch 176 is electrically connected to the first terminal of the first limit switch 150 by wire 402 with which the contact 172 may be electrically engaged.

Wire 404 electrically connects wire 402 with the briding contact 174 of control relay 161, wire 410 electrically connects the second terminal of limit switch 150 with bridging contact 180 of control relay 161 and wire 416 electrically connects the first contact of limit switch 152 with the bridging contact 186 of control relay 161. Further, wire 414 electrically connects the second contact of limit switch 152 electrically connected to bridging contact 184 with the third terminal of limit switch 150 with which bridging contact 182 is operatively associated.

Wire 384 electrically connects the second terminal of limit switch 156 with the third terminal of the limit switch 154 with which bridging contact 188 is electrically connected and wire 358 electrically connects wire 342 with the terminal of limit switch 156 with which bridging contact 204 is operatively associated while wire 382 electrically connects the terminal of limit switch 156 with which bridging contact 190 is operatively associated with the terminal of control relay 159 electrically connected to bridging contact 192 thereof. The control relay 159 is electrically connected to wire 398 by wire 366 and to wire 306 by wire 320. Further, wire 368 electrically connects the second terminal of control relay 159 with the second terminal of limit switch 154 with which bridging contact 194 is operatively associated and wire 348 electrically connects the first terminal of control relay 159 with the first terminal of limit switch 154 with which bridging contact 200 is operatively associated.

Wire 324 electrically connects wire 306 with one terminal of the motor starter relay 164 and the other terminal of the motor starter relay 164 is electrically connected to the first terminal of control relay 159 with which bridging contact 202 is electrically connected by wire 346. One terminal of the control relay 161 is electrically connected to wire 342 by wire 356 and the other terminal of control relay 161 is electrically connected to wire 306 by wire 322. Finally, wire 378 is electrically connected to the contact of control relay 159 with which bridging contact 192 is operatively associated by wire 311 and wire 370 is electrically connected to the contact of control relay 159 with which the bridging contact 196 is operatively associated by wire 340.

When the control switch 170 is actuated to open the portion 26 of the mattress assembly, contact 456 bridges wires 390 and 398 and provides current to the control relay 159 through wire 366. When the control relay 159 is energized, it breaks the normally closed contacts 202, 196 and 192 to prevent currect from back feeding from wire 348 to wire 346, from wire 340 to wire 368 and from wire 311 to wire 382. Without this control relay 159, the current would back feed and be supplied to both sides of the motor 48. Also, connected to control relay 159 is wire 320 which is connected to wire 306. Wire 400 is operatively associated with normally open contact 176 of timer relay 158 and the open contact 176 prevents current from passing through contact 176 at this time. Normally open contact 182 in limit switch 150 prevents current passing between wires 412 and 414. Normally closed 178 contact in limit switch 150 allows current to pass between wire 408 through contact 178 to wire 410 and normally closed contact 180 in control relay 161 will allow current to pass through contact 180 to wire 378. Control relay 159 is open because control relay 159 is energized through wire 366 and wire 320 and solenoid 72 is actuated until limit switch 150 is engaged. The normally closed contact 172 in limit switch 150 is connected to wire 404 and wire 404 is connected to normally closed contact 174 in control relay 161 allowing current to pass through contact 174 to wire 406 connected to starter relay 163. This will energize the motor starter relay 163 and close contact 208 which allows current to flow through wire 392 from wire 390 through contact 208 to wire 394 connected to the forward winding of the motor 48. The motor starter relay 163 is also connected to the wire 306 by wire 308.

At this point, the motor 48 will begin to run in the forward direction. When limit switch 150 is engaged, contact 172 will be opened stopping operation of motor 48, contact 178 will be opened to deactivate solenoid 72 and contact 182 will close to allow current to pass from wire 412 to wire 414 which is then connected to normally closed contact 184 in limit switch 152. Contact 184 is connected to wire 416 which is then connected to contact 186 of control relay 161 which is not energized at this time. This will allow current to pass to wire 372 which in turn is connected to wire 370.

Wire 340 is connected to wire 370 but control relay 159 is energized at this time and contact 196 is held open. Wire 374 connects wire 370 to timer relay 158 and timer relay is energized closing contact 176 after a time delay of approximately one-half second. This will allow current to pass from wire 400 through contact 176 into wire 402 which bypasses limit switch 150 and connects to wire 404 which in turn will restart motor 48 without changing the direction of rotation. Time relay 158 is also connected to wire 310 which is connected to wire 306 and wire 370 is finally connected to solenoid 74 actuating the latter. Wire 318 is connected to solenoid 74 and wire 306.

When motor 48 has run the required amount of tire, a stop will engage limit switch 152 opening contact 184 in limit switch 152. At this time, the timer relay 158 will deenergize opening contact 176 which will stop motor 148 and disengage solenoid 74.

The closing circuit for the mattress section 26 is energized by engaging control switch 170 to the closed position. This closes contact 458 and allows current to flow from wire 334 to wire 342. Wire 356 then supplies voltage to control relay 161. When relay 161 is actuated, normally closed contacts 174, 180 and 186 will be opened and this will prevent current from back feeding from wire 404 to wire 406 from wire 378 to wire 410 and from wire 372 to wire 416. Also connected to relay 161 is wire 322 which is connected to wire 306. Wire 358 is connected between wire 342 and the normally open contact 204 of limit switch 156. This will terminate the current flow at limit switch 156. Wire 350 is connected to normally open contact 198 of timer relay 160, open contact 198 preventing current from passing through contact 198 at this time.

Wire 354 is connected to the normally open contact 188 of limit switch 154 and wire 352 is connected to wire 342 and to the normally closed contact 194 of limit switch 154. This allows current to pass from wire 352 through contact 194 to wire 368 which is also connected to normally closed contact 196 of control relay 159 and allows current to pass through contact 196 into wire 340. Wire 340 is connected to wire 372 and therefore to the third contact of control relay 161 with which open contact 186 is operatively associated, contact 186 having been opened by energizing the control relay 161. This will stop the flow of current through open contact 186. Wire 370 is connected to wire 374 which in turn is connected to timer relay 158, but the bridging contact 176 is in the open position. Finally, wire 370 is connected to solenoid 74 to actuate the latter until limit switch 154 is engaged. Solenoid 74 is also connected to wire 318 which is connected to wire 306.

Wire 342 is connected to the normally closed contact 200 of limit switch 154 which is connected to wire 348 and wire 348 is connected to normally closed contact 202 of control relay 159 thereby allowing current to pass through contact 202 which is in turn connected to wire 346. Wire 346 is connected to motor starter relay 164 and closes normally open contact 209 allowing current to flow through wire 336 from wire 334 through contact 209 into wire 338 connected to the reverse windings of the motor 48. The starter relay 164 is also connected to wire 324 which is connected to wire 306.

At this point, the motor 48 will be operated in the reverse direction. When motor 48 has operated the required time, limit switch 154 will be engaged and open contact 200 in order to deactivate motor 48, open contact 194 to disengage solenoid 74 and to close contact 188 which now allows current to pass from wire 354 through contact 188 to wire 384. Wire 384 is connected to normally closed contact 190 of limit switch 156 and therefore to wire 382 which is in turn connected to contact 192 of control relay 159. This allows current to pass into wire 311 and wire 311 is in turn connected to wire 378. This connection to wire 378 will only allow current to flow in one direction at this time because control relay 161 is energized and contact 180 is in the open position. Wire 378 is connected to wire 380 which connects wire 378 to timer relay 160. Timer relay 160 is thereby energized closing contact 198 after a time delay of approximately one-half section. This will allow current to pass from wire 350 through contact 198 into wire 344 which bypasses limit switch 154 and connects to wire 348 which in turn will restart motor 48 without changing rotation. Timer relay 160 is also connected to wire 312 which is connected to wire 306.

When motor 48 has continued operation for the required time, limit switch 156 will be engaged and open contact 190 in limit switch 156. At this time, timer relay 160 will be deenergized opening contact 198 which will terminate operation of the motor 48 and disengage solenoid 62. Also, engagement of limit switch 156 will close normally open contact 204 and allow current to flow from wire 358 through contact 204 into wire 360. Wire 360 is connected to wire 362 and timer relay 162. Wire 362 is then connected to normally closed contact 206 in timer relay 162. Time relay 162 is also connected to wire 314 which is connected to wire 306. Contact 206 is connected to wire 364 which is in turn connected to pump 140 which will therefore be actuated for approximately 10 seconds. Pump 140 is also connected to wire 316 and thus to wire 306. When timer relay 162 "times out", this will complete operation of the control circuit 166.

Finally, if desired, a stopper 238 may be provided for the outlet neck 114 and the receiver 112, after being properly cleaned, may be used to collect a urine sample, which sample may be removed through a separate drain (not shown) or suctioned from the receiver 112.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hospital bed including a support frame incorporating head and foot mattress portions and an intermediate mattress portion disposed between said head and foot portions, said mattress portions being supported from said frame, one side of said intermediate portion being mounted from said frame for lateral outward and inward shifting of said one side of said intermediate portion from the corresponding side of said frame to outer and inner positions with an opening formed through said mattress inwardly of said one side and between the latter and the other side of said intermediate portion when said one side is in the outer position and closing said opening when said one side is in said inner position, an upwardly opening waste receiver supported from said frame beneath said intermediate portion in position for vertical registry with said opening when said one side is in said outer position, mounting means mounting said receiver from said frame for from said frame for vertical shifting relative thereto between a lowered position disposed below said mattress and a raised position projecting upwardly into said opening, reversible motor means including forward and reverse directions of operation, first and second drive means operatively connected with said one side and receiver, respectively, for outer and inward shifting of said one side to said outer and inner positions and for raising and lowering said receiver to said raised and lower positions, respectively, and control means including a pair of bed patient manually actuatable operators, said control means, upon actuation of one of said operators, including means operative to actuate said motor means in the forward direction of operation thereof and drivingly connect said motor means to said first drive means to shift said one side from said inner position to said outer position and, in response to said one side reaching said outer position, to momentarily interrupt operation of said motor means, disconnect said motor means from said first drive means and drivingly connect said motor means to said second drive means and thereafter reestablish operation of said motor means in the forward direction of operation thereof to raise said receiver from said lowered position to said raised position and to terminate operation of said motor means upon said receptable being elevated to said raised position, said control means, upon actuation of the other operator, including means operative to actuate said motor means in the reverse direction of operation thereof with said motor means drivingly connected to said second drive means to lower said receptacle to said lower position from said upper position and, in response to said receptacle reaching said lower position, to momentarily interrupt operation of said motor means and disconnect said motor means from said second drive means and drivingly connect said motor means to said first drive means and thereafter reestablish operation of said motor means in the reverse direction to shift said one side inwardly from said outer position to said inner position and terminate operation of said motor means in the reverse direction upon said one side being shifted to said inner position.

2. The bed of claim 1 wherein the upper periphery of said receiver includes an elongated peripherally extending flushing water manifold mounted therein and including longitudinally spaced downwardly opening outlets for discharging water downwardly into said receiver, and water supply means for supplying water under pressure to said manifold.

3. The bed of claim 2 wherein said water supply means includes a water reservoir supported from said bed.

4. The bed of claim 3 wherein said water supply means is mounted on said frame at an elevation higher than said manifold.

5. The bed of claim 2 wherein water supply means includes means for ducting water under pressure from a pressurized domestic water supply.

6. The bed of claim 1 wherein said receiver includes a lower outlet, a holding tank mounted from said frame beneath said mattress, said outlet being communicated with said holding tank.

7. The bed of claim 1 wherein said receiver means includes a lower outlet and drain means operatively associated with said outlet for ducting waste material flowing from said outlet to a domestic sewer system.

8. The bed of claim 1 including a lower outlet depending downwardly from said receptacle with which the inlet end of a waste discharge pipe is communicated by a tubular telescopic connecting sleeve assembly.

9. The bed of claim 1 wherein said head, foot and intermediate mattress portions are separately formed.

* * * * *